US005638759A

United States Patent [19]

Klugkist

[11] Patent Number: 5,638,759

[45] Date of Patent: Jun. 17, 1997

[54] SYSTEM FOR SETTING UP OFFICE AND/OR WORKING ENVIRONMENT

[76] Inventor: Jürgen Klugkist, Am Dingesberg 7, 61462 Königstein, Germany

[21] Appl. No.: 616,404

[22] Filed: Mar. 15, 1996

[30] Foreign Application Priority Data

Oct. 23, 1995 [DE] Germany ..... 295 16 695.9

[51] Int. Cl.[6] ..... A45B 35/00

[52] U.S. Cl. ..... 108/50; 108/23; 312/223.6

[58] Field of Search ..... 108/50, 144, 23; 312/223.3, 223.5, 223.6

[56] References Cited

U.S. PATENT DOCUMENTS

| | | | |
|---|---|---|---|
| 4,748,913 | 6/1988 | Favaretto et al. | 108/50 |
| 4,852,500 | 8/1989 | Ryburg et al. | 108/50 X |
| 5,103,741 | 4/1992 | Grund et al. | 108/50 |
| 5,186,425 | 2/1993 | Keusch et al. | 108/50 X |
| 5,237,935 | 8/1993 | Newhouse et al. | 108/50 |
| 5,277,131 | 1/1994 | Fortsch | 108/50 |
| 5,285,733 | 2/1994 | Waibel | 108/50 X |
| 5,357,874 | 10/1994 | Palmer | 108/50 |
| 5,394,809 | 3/1995 | Feldpausch et al. | 108/50 X |

FOREIGN PATENT DOCUMENTS

| | | | |
|---|---|---|---|
| 1115445 | 4/1956 | France | 312/223.5 |
| 3945726 | 5/1981 | Germany | 312/223.6 |

*Primary Examiner*—Jose V. Chen

[57] ABSTRACT

A system for setting up a working environment includes base elements of profile bars adapted to stand on a floor surface and pillar elements of profile bars, at least one incorporating a cable duct. The pillar elements are mounted on the base elements. A transverse connecting element is a profile bar and incorporates a cable duct and interconnects the pillar elements at a spacing from each other. Carrier elements of profile bars are mounted to the pillar elements. The pillar elements have substantially U-shaped profile portions including parallel side wall parts, and projections which extend in the longitudinal direction from the side wall parts and face towards each other. Heightwise adjustment is made by a holder having a holding portion introduced into the profile portions of the pillar elements and movable therein for heightwise adjustment. The holding portion includes slide elements and fixing elements for holding the slide elements and the holding portion in releasable fixed contact with longitudinal projections on the profile portions by the fixing elements.

18 Claims, 10 Drawing Sheets

Fig- 7
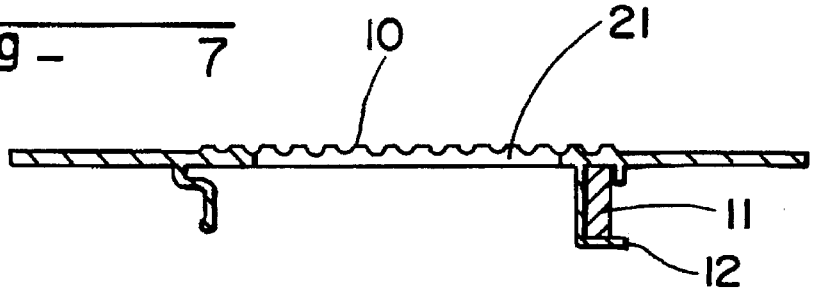
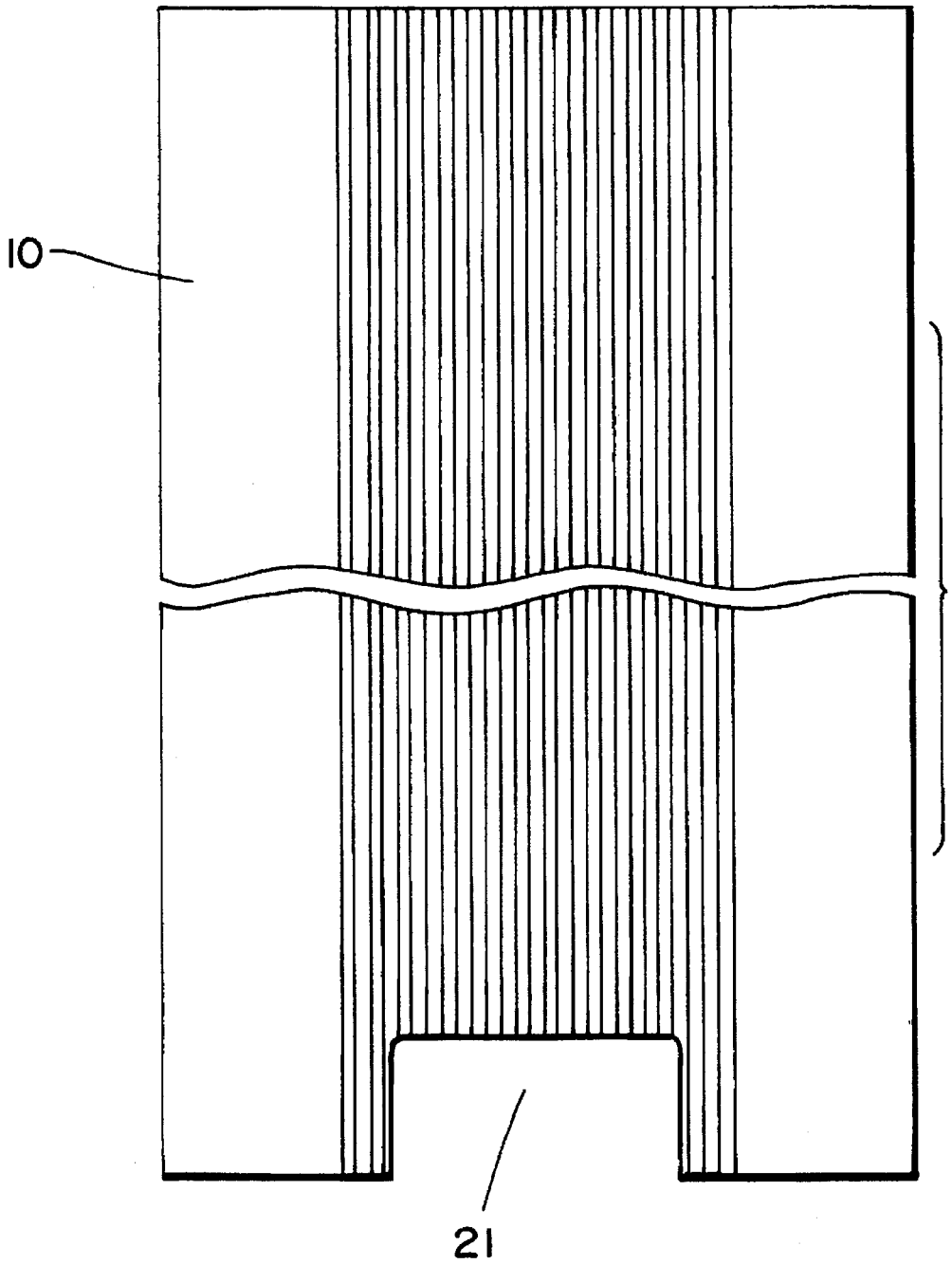
Fig- 8

SYSTEM FOR SETTING UP OFFICE AND/OR WORKING ENVIRONMENT

FIELD OF THE INVENTION

The present invention concerns a system for setting up an office and/or working environment and more especially a furniture system which can be flexibly adapted to various requirements in terms of activities to be conducted in association therewith.

BACKGROUND OF THE INVENTION

It is known for furniture systems to be made up from modular basic components. United Shoe Machines, USM-Haller, markets a furniture system in which substantially cuboidal connecting elements can hold connecting rods and the basic frame structure which is produced thereby and which is of a rectangular configuration then accommodates shelf members and the like. A disadvantage with that system is the predetermined, rigid arrangement of rectangular configuration, as well as the fact that it is impossible to afford flexible working environments with different working or useful surfaces which are for example of a non-rectangular configuration.

Wooden shelf arrangements are also known with ladder-like intermediate members for carrying shelf components. Those systems also suffer from a lack of flexibility in terms of the configuration of the working position and frequently they also suffer from their external appearance not being of high quality.

SUMMARY OF THE INVENTION

An object of the present invention is to provide a system for setting up a flexible and in particular height-adjustable office and/or working environment, in which the system advantages of a limited number of components does not substantially result in a limitation in terms of configurational options.

Another object of the present invention is to provide a system for setting up a working environment which affords versatility and flexibility in combination with a high-quality appearance and soundness of structure.

Still another object of the present invention is to provide a system for affording a working environment which can be quick and easy to assemble so as to enhance the adaptability thereof to varying working conditions.

In accordance with the principles of the present invention the foregoing and other objects are achieved by a system for setting up an office and/or working environment comprising a base element, a pillar element having a cable duct, a transverse connecting element with cable duct and a carrier or support element with mounting means for supporting a useful or working surface. The elements of the system are made from profile bars of aluminum materials and the pillar element includes a means for heightwise adjustment of the assembly.

In this specification the term working environment is used to denote any working environment such as a commercial working environment, an office working environment or for example a working environment in the home.

Further, in this specification, the term working surface is used to denote any useful or working surface in the broad sense, such as for example any table-like or plate-like member which is suitable for serving as a support for an activity, for example a desk top, a table top, a counter or bar top, a shelf surface or the like.

As will be seen in greater detail from a description hereinafter of preferred embodiments of the present invention, it is possible for working positions which can be freely grouped together or flexibly arranged in a required configuration to be constituted using simple main elements consisting of the base element, the transverse connecting element with cable duct, the pillar element with cable duct and the carrier element for supporting the working surface. The fact that those elements are made from profile bars of aluminum material reduces the weight of the system, in particular in terms of transportation and storage, facilitates association with the furnishings involved and nonetheless affords a high value in the long term by virtue of its properties in respect of strength and resistance to corrosion.

By virtue of the integration of supply and communications connections, for example network connections, telephone, telefax, e-mail connections and the like and in particular also by virtue of the possibility of fitting multi-point connectors for the supply of power or for cabling, the office environment provided can be virtually free from lines which are visible from the exterior.

The height-adjustment means operatively associated with the pillar element on the one hand permits optimum adaptation to personal preferences and ergonomic factors of the people working in the working environment, while on the other hand it makes it possible for working surfaces to be freely arranged in any desired configuration in a plurality of planes, for example in the case of shelf assemblies or in relation to counter or bar furniture.

In accordance with a preferred feature of the invention the pillar element has at least one U-shaped profile portion from whose internal at least substantially mutually parallel side wall parts extend first and second projections which face towards each other and which extend in the longitudinal direction of the pillar element. That configuration thus affords a mounting configuration for heightwise adjustment, with lateral sliding surfaces.

Another preferred feature of the invention provides that the means for heightwise adjustment includes a holder which is adjustable in respect of height, the holder having at least one holding portion adapted to be introduced into the above-mentioned U-shaped profile portion of the pillar element, and a support means on the holder for the carrier element. That provides a connecting arrangement between the carrier element and the pillar element so that essentially only two main components and fixing means associated therewith provide for adjustment in respect of height which is reliable in the long term while being simple to operate.

Preferably the holding portion includes a tubular portion which is adapted to be inserted into the U-shaped profile portion, adjustably in respect of height therein.

Another preferred feature of the invention provides that the holding portion includes releasably fixable fixing means for holding slide elements, whereby this arrangement can provide selectively for sliding or gripping contact against the projections in the profile portion of the pillar element.

In accordance with another preferred feature of the invention the holder has plate portions for connection to a transverse element, thereby affording the possibility of using different transverse elements. The width of the article of furniture afforded by the system can thus be selected and varied within wide limits by virtue of a free choice in terms of the length of the transverse element.

In accordance with another preferred feature of the system of the present invention there may be a pillar element in the form of an at least substantially round pillar element and which is provided both at its top end and its bottom end with fixing means for either a base member or a working surface. The inclusion of the further pillar element can provide small working areas of an island-like nature, it can provide for the formation of tables or the like, or in banks or in booking halls it can provide stand-up desks and writing surfaces for customers.

In accordance with still another preferred feature of the invention the pillar element and/or the further pillar element may be provided with an opening which extends in the longitudinal direction thereof and which is closeable by an associated cover. The associated cover and/or the pillar element and/or further pillar element has an opening for passing at least one cable therethrough. In that way, the above-mentioned cable and connecting lines can still be easily added to or removed from the system even after assembly of the arrangement.

In accordance with yet another preferred feature of the invention the cover is transparent and disposed within the pillar element and/or further pillar element are lighting means. That also permits the lighting arrangement to be of the appropriately optimum design configuration. The transverse connecting element may also be provided with the above-mentioned transparent cover and with lighting means disposed therebehind.

A still further preferred feature of the invention provides that the system includes an additional pillar element which is at least substantially octangular in cross-section with a lateral opening in its longitudinal direction and with a recess arranged therebehind for receiving a sliding element as part of the heightwise adjustment means. That arrangement makes it possible to provide working surfaces such as table tops, table surfaces and counter or bar surfaces, in a plurality of planes.

The system may further include a frame structure for carrying the working surface, which frame structure can be for example rectangular, trapezoidal or triangular. The frame structure may hold different shelf or counter or bar surfaces in superposed relationship according to the respective height of that additional pillar element.

It will also be noted that the above-mentioned profile bars of aluminum material can be improved in terms of their stability by means of ribs extending in the longitudinal direction thereof, while still being of desirably low weight.

Further objects, features and advantages of the system according to the principles of the present invention will be apparent from the following description of preferred embodiment thereof.

BRIEF DESCRIPTION OF THE DRAWING

FIG. 7 is a plan view of a cover associated with the pillar element shown in FIGS. 3*a* and 3*b*, with an inserted elastic body, FIG. 8 is side view of the cover shown in FIG. 7.

DESCRIPTION OF PREFERRED EMBODIMENTS

In the detailed description set out hereinafter of preferred embodiments of a system according to the invention for setting up a working environment, reference will firstly be made to FIGS. 1 and 2.

Figure 1:
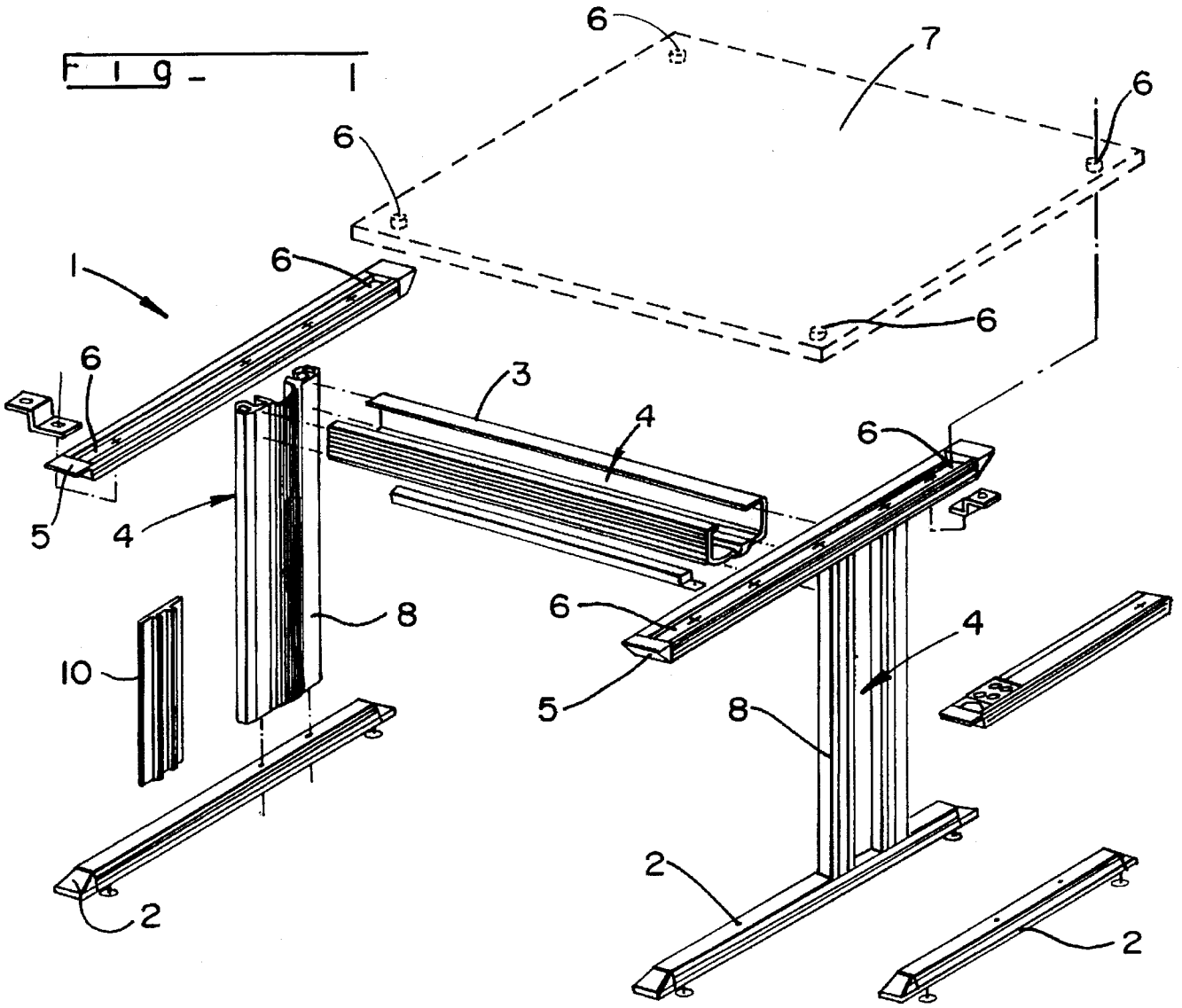
FIG. 1 is an exploded view of a first embodiment given by way of example of the furniture system according to the invention in the form of a desk.

The system shown in FIG. 1 in the form of a desk which is generally identified by reference numeral 1 has first and second base elements 2, a transverse connecting element 3 with cable duct 4, and first and second carrier elements 5 with mounting means 6 for a useful or working surface as indicated at 7. The mounting means 6 may include conventional screw connections, retaining or detent connections or dowels, but they are preferably of a releasable nature. First and second pillar elements 8 which are also provided with a respective cable duct 4 are adapted to be mounted on respective ones of the base elements 2 in upstanding relationship thereon, and the respective carrier elements 5 are mounted to the upper ends of the pillar elements 8. The base elements 2, the pillar elements 4, the carrier elements 5 and the transverse connecting element 3 comprise profile bars of aluminum material. As can be seen from FIGS. 1 and 2, open ends of the profile bars are closed by respective terminal portions which conically taper the profile of the bars.

Figure 2:
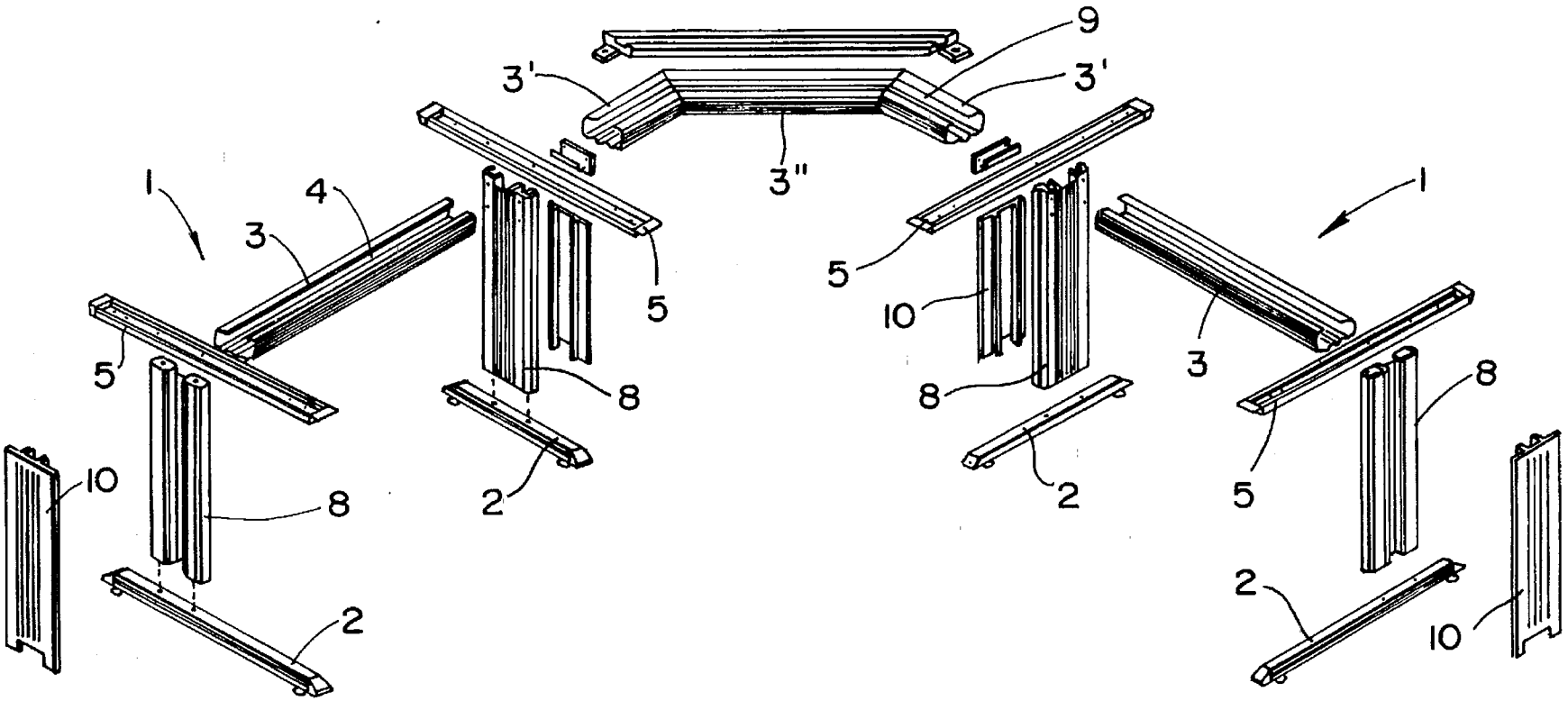
FIG. 2 shows an embodiment of the invention formed by an enlargement of the embodiment shown in FIG. 1 to give two desks connected together by at least a cable duct.

In all embodiments illustrated herein the pillar elements 8 and the transverse connecting elements 3 have a lateral opening as indicated for example at 9 in relation to the transverse connecting element 3', which is closeable with an associated cover as indicated in both FIGS. 1 and 2 at 10. The covers 10 may also comprise aluminum or alternatively another suitable material which may be a transparent material. In the latter case suitable lighting means may be disposed behind the transparent cover and thus can afford a further flexible design configuration in regard to lighting for the working area. Lighting 10' is shown in FIGS. 3*b* and 17.

Figure 3A:
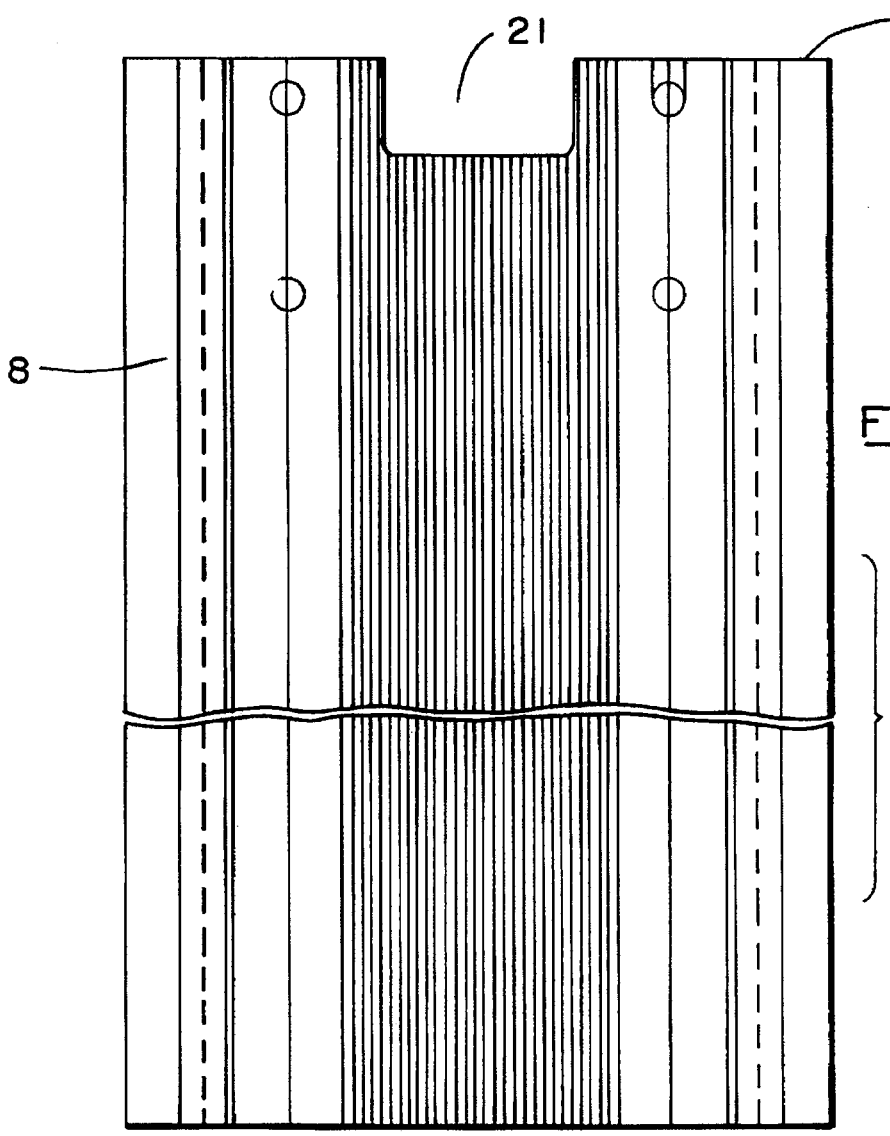
FIGS. 3*a* and 3*b* show a side view and a plan view of a first pillar element of the furniture system according to the invention.
Figure 3B:
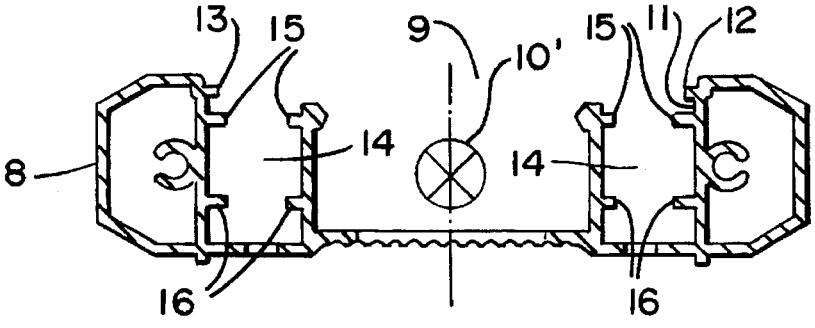
Figure 17:
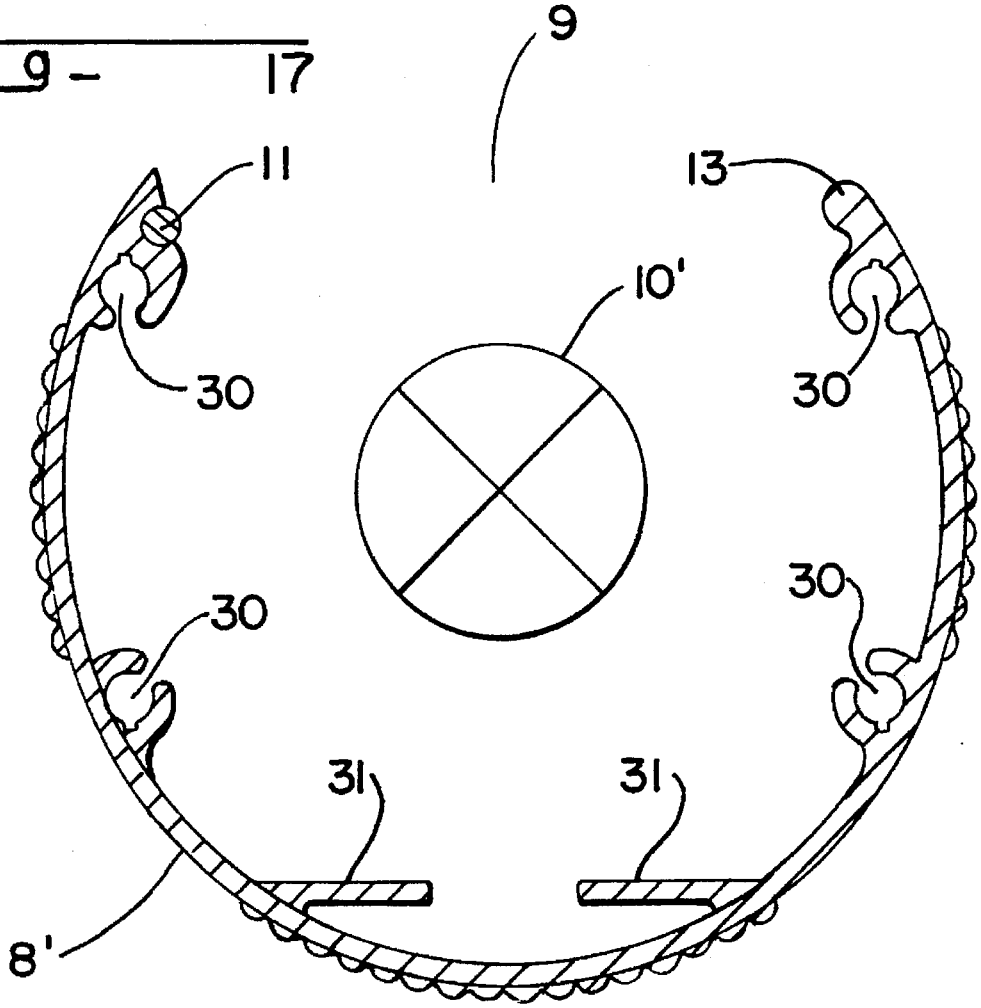
FIG. 17 is a cross-sectional view of a further pillar element of substantially circular cross-section for making tables and/or high desks.
Figure 18:
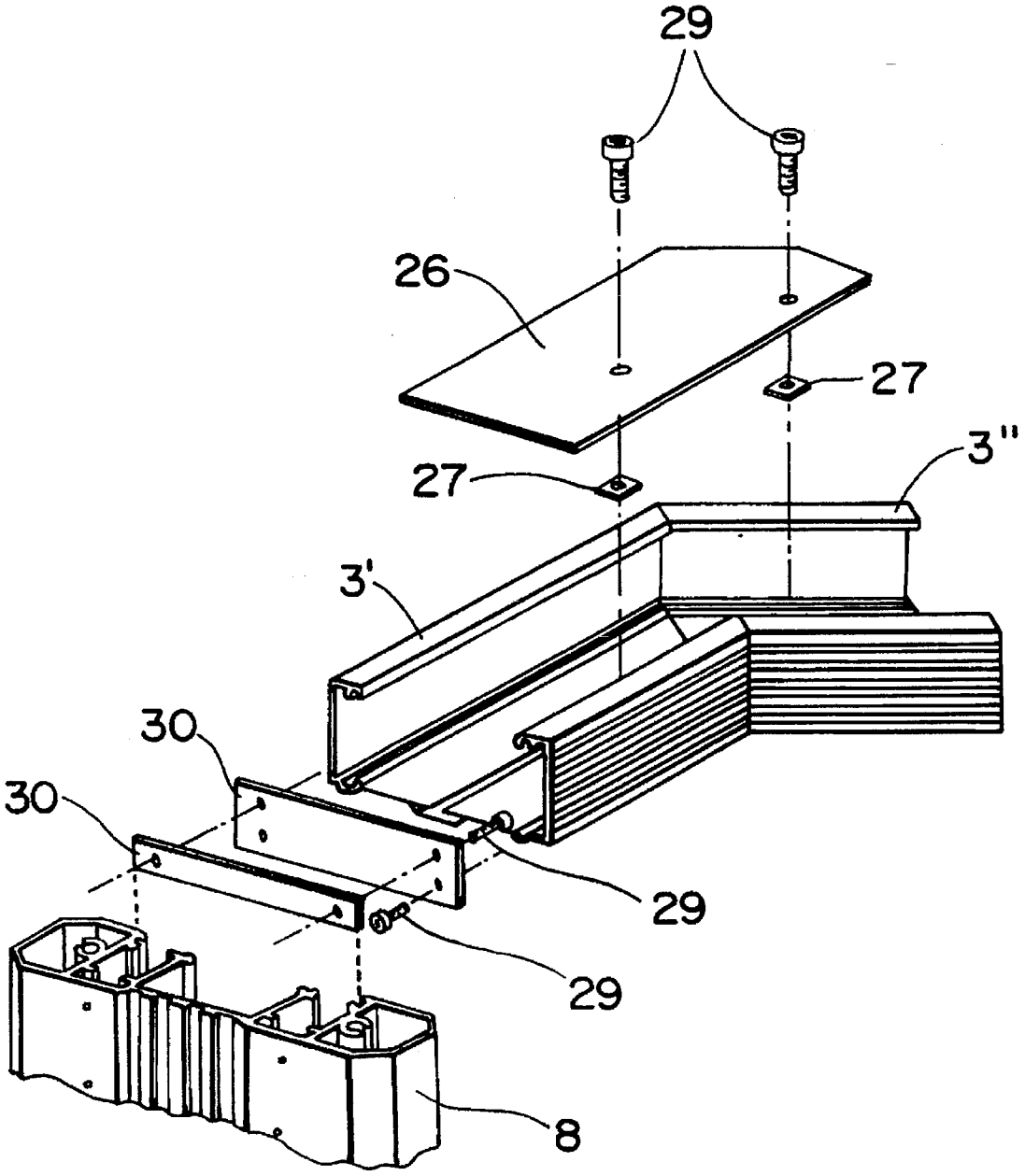
FIG. 18 is a detail view of fixing means used by way of example in accordance with the invention for making corner connections involving angles of 45° or 90°.

As can best be seen from FIGS. 3, 7 and 17 either the cover 10 or the pillar element 8 includes an elastic body 11 which, when the cover 10 is mounted to the pillar element 8, provides for elastic retaining forces to hold the cover 10 in position. It is thus possible for the cover which is in the form generally of a cover plate to be pressed into latching engagement onto the opening 9 thereby, as in that case the elastic body 11 is pushed back from a portion associated therewith, as indicated at 12 in for example FIGS. 3*b* and 7, and, with an oppositely disposed nose as indicated at 13 in FIG. 3*b*, securely holds the cover 10 in position without play.

If the elastic body 11 is mounted to the cover 10 the projecting portion 12 on the pillar element 8 serves as a contact surface; if the elastic body 11 is mounted to the pillar element 8 (see FIGS. 7 and 3*b*) the projecting portion 12 on the cover plate 10 serves as a contact surface.

Reference is now made to FIG. 3*b* showing that the pillar element 8 has at least one and, as illustrated, two U-shaped profile portions 14. The profile portions 14 include at least substantially mutually parallel side wall parts, from each of which extend two projections 15 which are elongate in the longitudinal direction of the pillar element 8, on the mutually facing surfaces of the side wall parts of the profile portions 14, with the projections 15 facing towards each other. Two further projections 16 which also extend in the longitudinal direction and which also face towards each other, together with the projections 15, form a receiving means for a holding portion as indicated generally by reference numeral 17 in FIGS. 5 and 6 to which attention is now directed.

Figure 5:
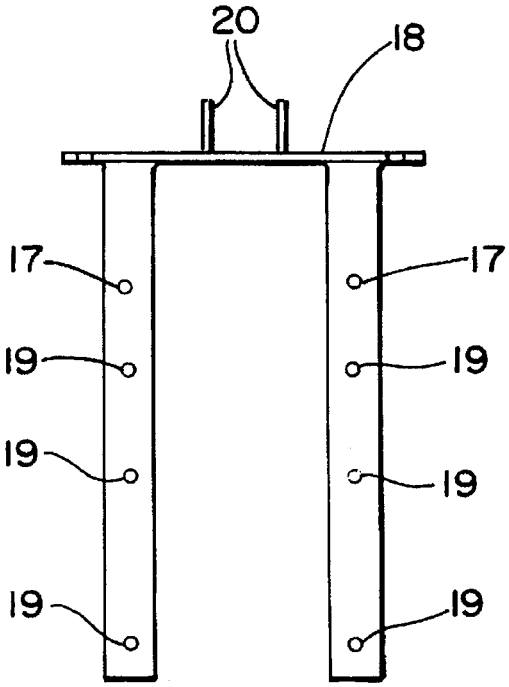
FIG. 5 is a side view of the holder shown in FIG. 4.
Figure 6:
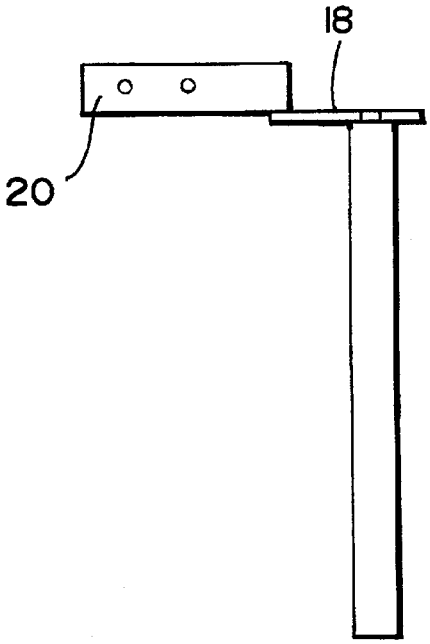
FIG. 6 is a front view of the holder shown in FIGS. 4 and 5.
Figure 10:
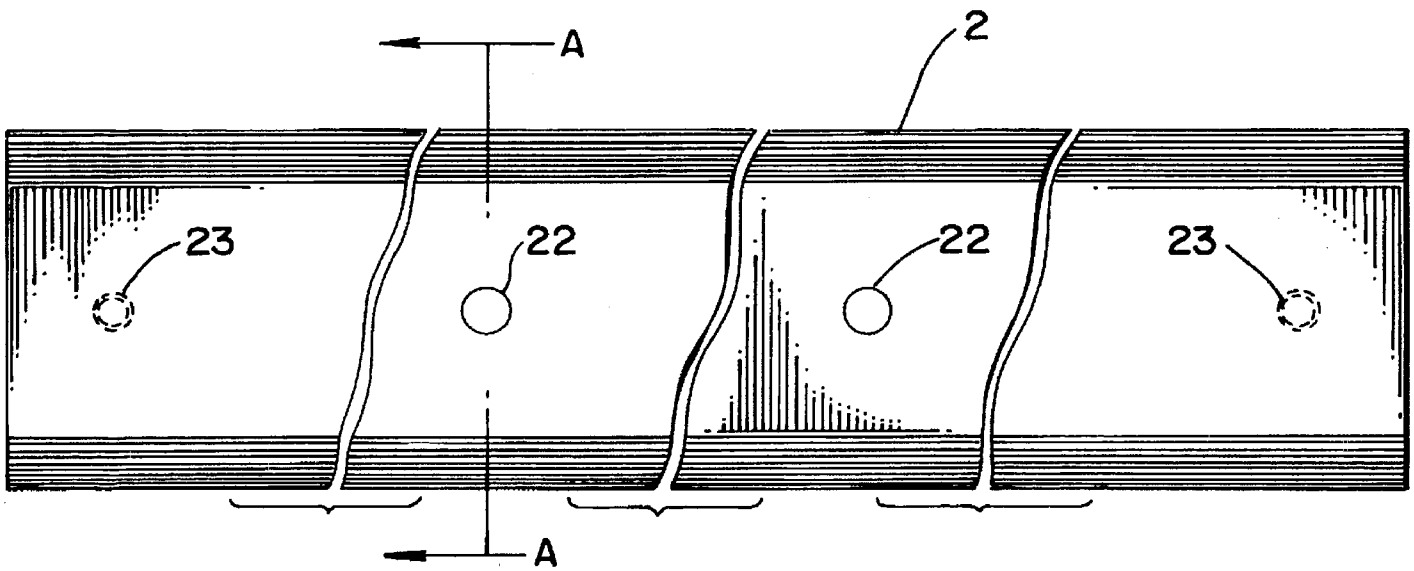
FIG. 10 is a plan view of the base element shown in FIG. 9.
Figure 9:
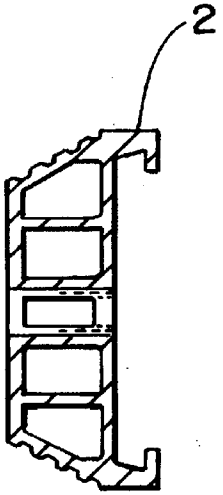
FIG. 9 is a view in cross-section through a base element taken along line A—A in FIG. 10.
Figure 11:
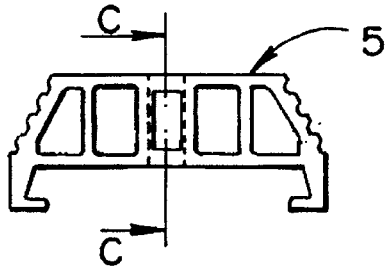
FIG. 11 is a view in cross-section through a carrier element taken along line B—B in FIG. 13.
Figure 12:
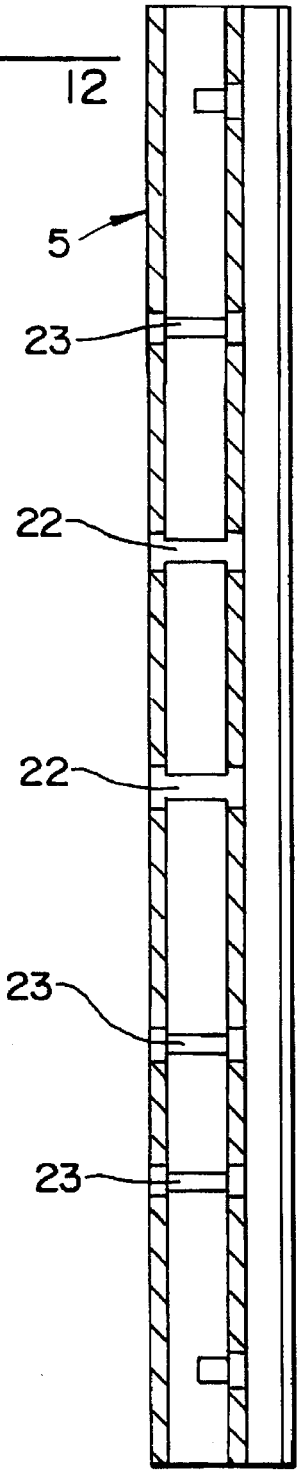
FIG. 12 is a view in cross-section of the carrier element of FIG. 11 in the longitudinal direction thereof taken along line C—C in FIG. 11.
Figure 13:
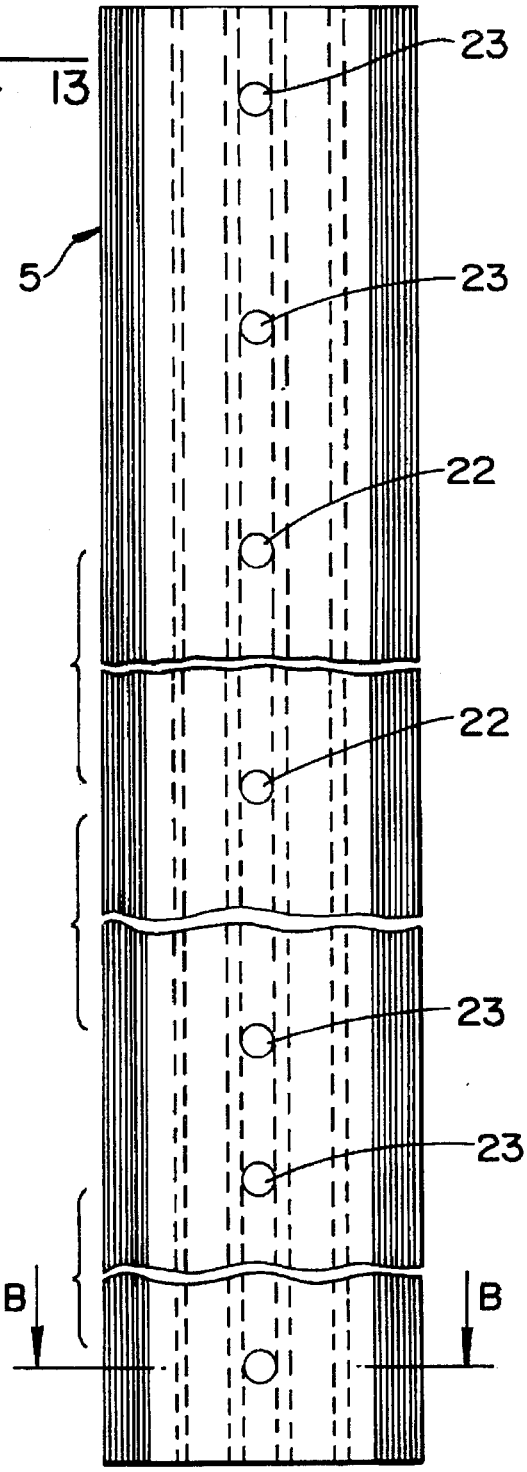
FIG. 13 is a view from below of the carrier element shown in FIGS. 11 and 12.
Figure 14:
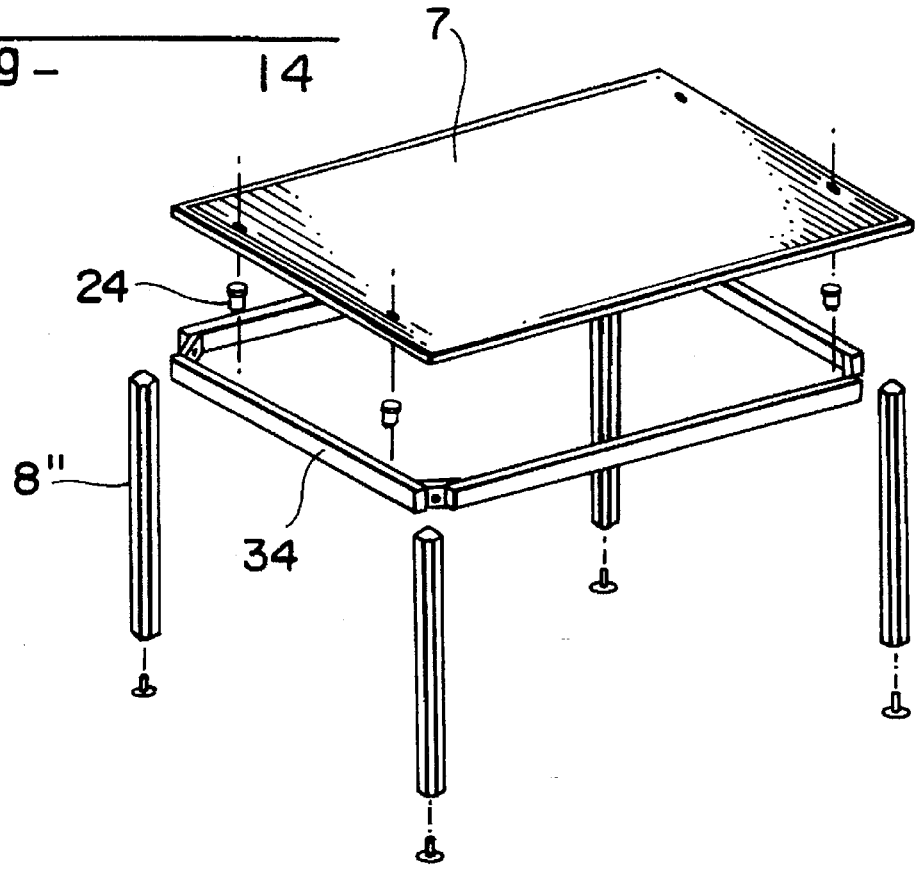
FIG. 14 is an exploded perspective view of an embodiment of the system according to the invention in the form of a simple table with a rectangular frame element and further pillar elements according to the invention.

The holding portion 17 in FIGS. 5 and 6 is in the form of a tubular portion constituting part of a holder 18. The tubular portion 17 is thus adapted to be inserted into the profile portions 14 and is adjustable in respect of height therein.

The holder 18 which is provided with a plurality of screwthreaded bores 19 can thus be inserted from above into the pillar element 8 and, with one of the screwthreaded bores 19, can hold a slide element in the form of a plate or bar portion in selective sliding contact, that is to say in sliding or frictional engagement, with one of the projections 15 or 16.

Figure 4:
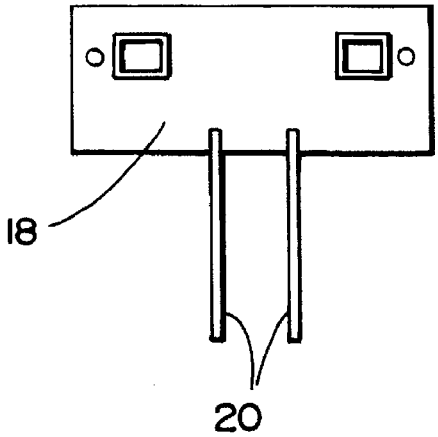
FIG. 4 is a plan view of a holder of height-adjustment means of the system according to the invention.

Mounted on the top side of the holder 18, as shown in FIGS. 4 through 6, are lateral plate portions 20 by means of which transverse connecting elements as indicated for example at 3 in FIG. 1 can be held in position. Fitting transverse connecting elements of different lengths makes it possible to produce pairs of holders 18 which are adapted in terms of width to the respective requirements involved.

As shown in FIGS. 3*a* and 8, apertures 21 for passing at least one cable therethrough can be provided in the upper and/or lower regions of the pillar element 8 and the cover 10. As indicated by the small arrows shown in relation to the rounded corners of the apertures 21, the apertures 21 have rounded, burr-free edges.

Reference is now directed to FIGS. 9 through 13 showing preferred embodiments of the base element 2 and the carrier element 5. The cross-sectional views in FIGS. 9 and 11 each show a hollow-chamber profile configuration which is capable of withstanding high forces. Reference numeral 22 indicates through bores while reference numeral 23 indicates screwthreaded bores, thus affording flexible fixing options. The remainder of the structure of the elements shown in FIGS. 9 through 13 is thought to be self-evident from the illustrations and therefore does not need to be described in greater detail herein.

Figure 15:
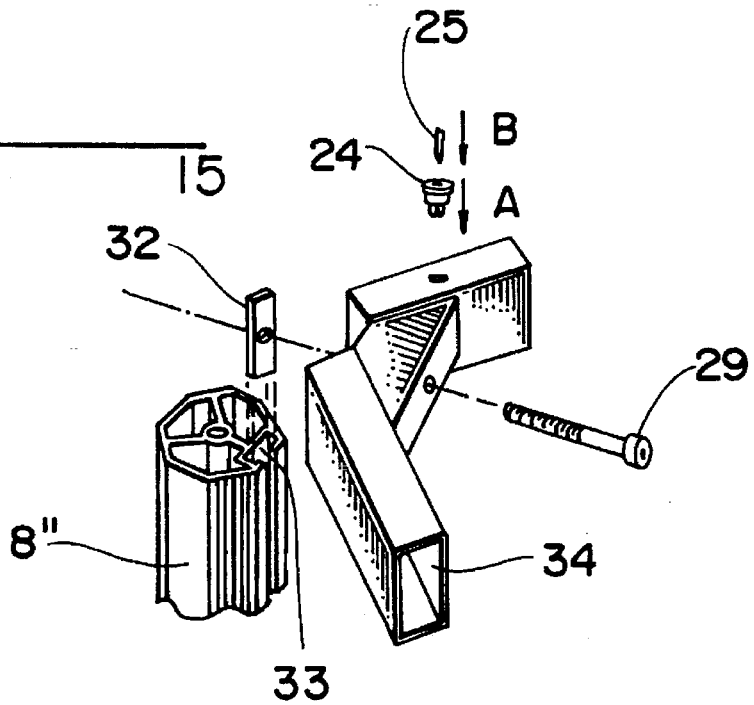
FIG. 15 is a view on an enlarged scale of a corner region of the structure shown in FIG. 14.

Referring to FIG. 15 at this point, reference numeral 24 therein illustrates by way of example dowels which can retainingly hold pins or pegs 25 which are suitably fixed to a working surface 7, thereby to locate the working surface on the support frame structure formed by the elements of the system according to the invention.

Referring now to FIGS. 14 through 18, in conjunction with FIG. 2, modified configurations in accordance with the invention of the transverse connecting element 3 and the pillar element 8 are illustrated therein. For the purposes of flexibly combining a plurality of working surfaces 7, transverse elements as indicated at 3' and 3" which extend in angular relationship relative to each other can be connected together. The preferred angle at which those transverse connecting elements 3' and 3" are connected together is 22.5°, without however thereby limiting the generality of that angle. When using two transverse connecting elements 3' each having a respective bevel or angular end configuration and a transverse connecting element 3" with two bevel or angular end configurations, it is possible to produce a corner angle of 90°, but when the transverse connecting elements 3' each having a respective bevel or angular end configuration are directly connected together, that gives an angle of 45°. As shown in particular in FIG. 18, the connection between the angular transverse connecting elements 3' and 3" can be effected by means of an inserted plate 26 which holds by frictional engagement slide members 27 guided in a groove 28, by means of screws 29. By way of example, plate or bar portions are also indicated at 30 in FIG. 18 for contact in frictional engagement against the projections 15 of the pillar element 8. This affords an additional adjustability in respect of height of the transverse connecting elements.

Figure 16:
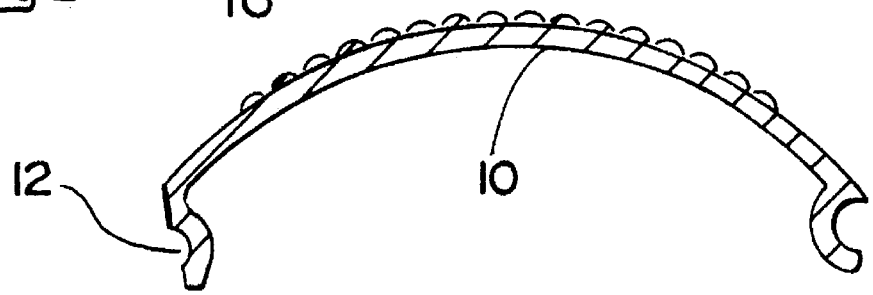
FIG. 16 shows a cover for the further pillar element shown in FIG. 17 of substantially round cross-section.

Looking now at FIGS. 16 and 17, shown therein is a pillar element 8' which is of a round configuration in cross-section. Provided both at the top end and at the bottom end are fixing means as indicated at 30, for example for securing base members or working surfaces or the like, which fixing means can include screwthreaded bores, dowel mountings or the like. In its interior, as shown in FIG. 17, the pillar element 8' has two plate portions 31 which extend towards each other in opposite relationship in a rearward wall region of the pillar element 8' and which serve for mounting components such as connector sockets, connector plugs or a circuit board, on which suitable connector sockets and connector plugs for electronic office equipment can be arranged.

Accordingly in a high or stand-up desk which is constructed by means of the further pillar 8' all necessary cables and connecting lines for any required office equipment can be laid therein.

Reference will be made again at this point to FIGS. 14 and 15 showing still a further pillar element 8" which is of an octangular cross-section and which at one side has an elongate opening which extends in the longitudinal direction of the pillar 8". The elongate opening is shown in FIG. 15 but is not referenced therein, but it corresponds generally to the opening indicated at 9 in FIG. 3*b* in the pillar element 8. A slide element 32 which is fitted into a recess 33 behind the elongate opening in the pillar element 8" is held in position in the pillar element 8" by frictional engagement by means of a screw 29 which also passes through a part of the frame structure 34 formed by the system according to the invention. In this respect the corner of the frame structure 34 is of a substantially congruent configuration relative to three side walls of the pillar element and permits fixing thereof at any suitably desired height.

It will be appreciated that, although this is not explicitly illustrated in the drawings, any desired multi-storey arrangements can be adopted when employing the pillar element 8" with the slide elements 32 suitably slidably carried thereby. It will also be noted that the frame structure 34 is shown in the drawings as being of a rectangular configuration, only by way of example thereof, and that essentially any desired geometrical structures can be produced therewith.

It will be appreciated that the foregoing embodiments of the system in accordance with the principles of the present invention have been set forth solely by way of example and illustration thereof and that various other modifications and alterations may be made therein without thereby departing from the spirit and scope of the invention.

What is claimed is:

1. A system for setting up a working environment comprising:

a base element;

a pillar element having a cable duct and adapted to be supported on said base element;

a transverse connecting element with cable duct; and a carrier element with mounting means for a working surface, wherein said elements are made from profile bars of aluminum material, said pillar element includes a means for heightwise adjust, and has at least one at least substantially U-shaped profile portion includes at least substantially mutually parallel side wall parts, said profile portion further including first and second projections which extend in the longitudinal direction thereof from the mutually facing surfaces of said side wall parts and face towards each other, said means for heightwise adjustment includes a holder having at least one holding portion adapted to be introduced into said profile portion of said pillar element and adapted to be movable therein for said heightwise adjustment, and a support means on said holder for said carrier element, said holding portion includes slide elements and fixing means for holding said slide elements and said holding portion in releasably fixable contact with said projections on said profile portion.

2. A system as set forth in claim 1, wherein said holding portion includes a tubular portion which is adapted to be inserted into said profile portion adjustably in respect of height therein.

3. A system as set forth in claim 1, wherein said holding portion and said slide elements can be brought into selective sliding contact with said projections by said fixing means.

4. A system as set forth in claim 1, wherein said holding portion includes a tubular portion which is adapted to be inserted into said profile portion adjustably in respect of height therein.

5. A system as set forth in claim 1 wherein said holding portion and said slide elements can be brought into selective sliding contacting with said projections by said fixing means.

6. A system as set forth in claim 1 wherein said holder is provided with plate portions for connection to a said transverse connecting element.

7. A system as set forth in claim 1 including a further pillar element in the form of an at least substantially round pillar having a first end and a second end, and further including fixing means at the first and second ends of said further pillar element for fixing a base member and a working surface respectively.

8. A system as set forth in claim 7 wherein said further pillar element has an opening which extends in the longitudinal direction thereof, and further including a cover means for closing said opening, at least one of said cover means and said further pillar element having an aperture for passing a cable therethrough.

9. A system as set forth in claim 8 and further including an elastic body wherein said further pillar element has a receiving means extending in its longitudinal direction for accommodating said elastic body and said elastic body is adapted to produce a holding force for a latching connection between said further pillar element and said cover means.

10. A system as set forth in claim 8 wherein said cover means is transparent and including lighting means disposed within said further pillar element.

11. A system as set forth in claim 1 wherein said pillar element has an opening which extends in the longitudinal direction thereof, and further including a cover means and said pillar element having an aperture for passing a cable therethrough.

12. A system as set forth in claim 11 and further including an elastic body, wherein said pillar element has a receiving means extending in its longitudinal direction for accommodating said elastic body and said elastic body is adapted to produce a holding force for a latching connection between said pillar element and said cover means.

13. A system as set forth in claim 11 wherein said cover means is transparent and including lighting means disposed within said pillar element.

14. A system as set forth in claim 1 wherein said transverse connecting element has an opening, a transparent cover means for said opening, and a lighting means disposed behind said opening.

15. A system as set forth in claim 1 and further including an additional pillar element which is at least substantially octangular in cross-section with a lateral opening in the longitudinal direction and with a recess arranged behind said opening for receiving a sliding element as part of said heightwise adjustment means.

16. A system as set forth in claim 15 including a frame means for holding a said working surface having lateral openings for substantially positively locking contact of a portion of said additional pillar element.

17. A system for setting up a working environment including: first and second base elements comprising profile bars of aluminum material and adapted to stand on a floor surface; first and second pillar elements comprising profile bars of aluminum material and at least one of said pillar elements incorporating a cable duct and said pillar elements being adapted to be mounted on respective ones of said base elements in upstanding relationship thereon; a transverse connecting element comprising a profile bar of aluminum material and incorporating a cable duct and adapted to interconnect said first and second pillar elements at a spacing from each other; first and second carrier elements comprising profile bars of aluminum material and adapted to be mounted to respective ones of said pillar elements; mounting means on said carrier elements for mounting a working surface means thereon; and means operatively associated with said pillar elements for heightwise adjustment; wherein at least one pillar element has at least one at least substantially U-shaped profile portion including at least substantially mutually parallel side wall parts, said profile portion further includes first and second projections which extend in the longitudinal direction thereof from the mutually facing surfaces of said side wall parts and face towards each other, said means for heightwise adjustment includes a holder having at least one holding portion adapted to be introduced into said profile portion of said pillar element and adapted to be movable therein for said heightwise adjustment, and a support means on said holder for said carrier element and said holding portion includes slide elements and fixing means for holding said slide elements and said holding portion in releasable fixable contact with said longitudinal projections on said profile portions.

18. A system as set forth in claim 17 wherein each said pillar element has at least one at least substantially U-shaped profile portion forming a part of said pillar element and defining a cavity therein, and wherein said means for heightwise adjustment includes a holder having at least one holding portion adapted to be introduced into said cavity and adapted to be movable therein in the longitudinal direction of the respective pillar element for providing for said heightwise adjustment.

* * * * *